US007549425B2

(12) United States Patent
Koga et al.

(10) Patent No.: US 7,549,425 B2
(45) Date of Patent: Jun. 23, 2009

(54) METHOD OF REDUCING NITROSAMINE CONTENT IN TOBACCO LEAVES

(75) Inventors: Kazuharu Koga, Oyama (JP); Satoshi Katsuya, Oyama (JP)

(73) Assignee: Japan Tobacco Inc., Tokyo (JP)

( * ) Notice: Subject to any disclaimer, the term of this patent is extended or adjusted under 35 U.S.C. 154(b) by 418 days.

(21) Appl. No.: 11/094,275

(22) Filed: Mar. 31, 2005

(65) Prior Publication Data

US 2006/0225750 A1 Oct. 12, 2006

(51) Int. Cl.
*A24B 15/00* (2006.01)

(52) U.S. Cl. ..... 131/290

(58) Field of Classification Search ..... 131/290; 800/317.3

See application file for complete search history.

(56) References Cited

U.S. PATENT DOCUMENTS

| | | | | | |
|---|---|---|---|---|---|
| 4,566,469 | A | * | 1/1986 | Semp et al. | 131/308 |
| 4,622,982 | A | * | 11/1986 | Gaisch et al. | 131/297 |
| 4,709,710 | A | * | 12/1987 | Gaisch et al. | 131/308 |
| 6,564,808 | B1 | * | 5/2003 | Hempfling et al. | 131/297 |
| 2001/0000386 | A1 | | 4/2001 | Peele | |

FOREIGN PATENT DOCUMENTS

| | | | | |
|---|---|---|---|---|
| EP | 1 504 679 | A1 | | 2/2005 |
| JP | 2001-158710 | | * | 6/2001 |
| WO | WO-83/01180 | A1 | | 4/1983 |
| WO | WO-98/05226 | A1 | | 2/1998 |
| WO | WO-01/35770 | A1 | | 5/2001 |
| WO | WO-02/13636 | A1 | | 2/2002 |
| WO | WO-03/094639 | A1 | | 11/2003 |

* cited by examiner

*Primary Examiner*—Carlos Lopez
(74) *Attorney, Agent, or Firm*—Birch, Stewart Kolasch & Birch, LLP

(57) ABSTRACT

A method of reducing the content of TSNA in tobacco leaves, comprising treating the tobacco leaves with a microorganism having no nitrate-reducing ability but having the ability of growth-competition with a microorganism belonging to *Enterobacter* or *Pantoea* genus.

6 Claims, No Drawings

METHOD OF REDUCING NITROSAMINE CONTENT IN TOBACCO LEAVES

BACKGROUND OF THE INVENTION

1. Field of the Invention

The present invention relates to a method of reducing the content of tobacco specific nitrosamines (hereinafter referred to as "TSNA") in tobacco leaves. More particularly, the invention relates to a method of reducing TSNA content in the tobacco leaves by inhibiting microbial growth involved in production of nitrite, a precursor of TSNA.

2. Description of the Related Art

TSNA contained specifically in cured tobacco leaves are not present in tobacco leaves immediately after harvest; however, during the curing process and storage process thereafter, TSNA are formed by reaction of nitrite and alkaloids contained in the tobacco leaves. The main components of TSNA formed in such a manner are N-nitrosonornicotine (hereinafter, referred to as "NNN"), 4-(N-nitrosomethylamino)-1-(3-pyridyl)-1-butanone (hereinafter, referred to as "NNK"), N-nitrosoanatabine (hereinafter, referred to as "NAT"), N-nitrosoanabasine (hereinafter, referred to as "NAB"), and the like.

The varieties of tobacco cultivated in Japan are broadly classified into three groups; flue-cured tobacco, Burley tobacco, and Japanese domestic tobacco.

The harvested tobacco leaves are green, but chlorophyll in the plant cell is degraded and carotenoide pigment appears during curing process. The carotenoide pigment is a yellow color pigment and thus the color of the tobacco leaves turns to be yellow.

With respect to the flue-cured tobacco, after the tobacco leaves turn to be yellow, the speed of dehydration is quickened by raising the curing temperature, and finally the color of the cured leaves is fixed to be yellow.

On the other hand, with respect to Japanese domestic and Burley tobaccos, the curing process still continues after yellowing stage, and during the continuous curing stage, the carotenoide pigment is degraded and a brown pigment is produced to turn tobacco leaves to be brown. After that, the lamina and stem are completely dried and the curing process is finished. As described, the Burley and Japanese domestic tobacco leaves turn to be cured leaves through yellowing, browning, and stem drying stages.

The flue-cured tobacco and the Burley and Japanese domestic tobaccos differ in the curing methods. In the case of curing the flue-cured tobacco, harvested tobacco leaves are hung in a curing barn (a bulk curing barn) equipped with a heater, and cured while the temperature and humidity being controlled by using wind and fire powers, so that the tobacco leaves are cured in 5 to 7 days through the yellowing stage, color-fixing stage, and stem drying stage. On the other hand, in the case of curing the Burley and Japanese domestic tobaccos, harvested tobacco leaves are hung in a pipe house or a wooden curing house and cured while the temperature and humidity being controlled mainly in natural conditions, so that the tobacco leaves are cured in 25 to 35 days through the yellowing stage, browning stage, and stem drying stage.

Such curing of the tobacco leaves is carried out aiming not only to dry the tobacco leaves but also to convert the components in the tobacco leaves and provide colors, flavor and taste that are specific to the tobacco varieties. Thereafter, for maturing further flavor and taste, the tobacco leaves that have been finished the curing process are stored. However, during such curing and storage processes, the formation of TSNA is caused by a reaction of nitrite with alkaloids contained in the tobacco leaves. In the case of flue-cured tobacco, TSNA are formed mainly during curing by heating and in the case of Burley tobacco, TSNA are formed from the browning stage to stem drying stage in the curing processing steps.

It has been known that laminas of tobacco leaves immediately after harvest contain amino acids, proteins, and alkaloids as well as nitrate and nitrite. Generally, plants produce amino acids from nitrate via nitrite in vivo and utilize the amino acids for formation of the plant. On the other hand, since nitrite in a high concentration causes adverse effects on life of the plant, plants synthesize only in the minimum amounts required for utilization for the plant formation. Accordingly, the content of the nitrite-nitrogen in the tobacco leaves is 1 ppm or lower immediately after harvest.

However, during the curing process of the tobacco leaves, because of the function of nitrate reducing enzymes produced by microorganisms existing in the tobacco leaf surface, the nitrate in the tobacco leaves is reduced to nitrite. The produced nitrite is reacted with alkaloids in the tobacco leaves, so that TSNA are formed and accumulated in the leaves.

Conventionally, various techniques for reducing the TSNA content in the tobacco leaves have been proposed and for example, there have been proposed as follows.

In terms of cultivation of tobacco, there is a method of decreasing the amount of a nitrogen fertilizer to be used. Decrease of the amount of the nitrogen fertilizer reduces the alkaloid content in the leaves, which are origin substances of TSNA formation. It has been proved that the TSNA content in the leaves is decreased by the method.

In terms of plant breeding, new varieties having less alkaloid content in the leaves have been developed. In such development, seeds are taken out of plants having less alkaloid content and cultivated, so that varieties having a low TSNA content can be obtained.

With respect to flue-cured tobacco, there is proposed a method of reducing TSNA content by adopting an indirect-heating type of curing barn in place of a direct-heating type of curing barn. In this method, use of the indirect-heating type of curing barn reduces $NO_x$, a precursor of TSNA, derived from fuel, so that the TSNA production is suppressed during the curing process (US Patent Application Publication No. US 2001/386).

Further, there is proposed a method of rapidly dehydrating and completing the curing process by treating tobacco leaves having a low TSNA content in the yellowing stage of the initial curing process with microwave (WO 98/05226). However, the method finishes curing in the middle of the conventional curing process and results in insufficient change in the components contained in the leaves. Thereby, the purpose of the curing is not accomplished, and it is impossible to exhibit characteristic color, flavor and taste. Accordingly, there occurs a problem that the flavor and taste of the tobacco leaves which have been cured more rapidly is deteriorated as compared with those of the tobacco leaves cured by a conventional method.

To inhibit reduction of nitrate in the tobacco leaves to nitrite by the function of the nitrate-reducing enzymes produced by microorganisms existing in the tobacco leaf surface during the curing process of the tobacco leaves, there is proposed a method of removing the relevant microorganisms in the tobacco leaf surface. For example, a method of washing out the microorganisms with bicarbonate of soda (WO 01/35770), a method of killing microorganisms with chlorine dioxide gas (WO 02/13636), and the like have been know.

Also, a denitrification treatment of the tobacco cured leaves by using a microorganism derived from tobacco leaves (WO 83/01180) is disclosed. However, the method makes it possible to decrease the content of nitrate and nitrogen compounds in the tobacco cured leaves but is insufficient to efficiently reduce TSNA content.

The inventors of the present invention have proposed a method of using TSNA-degrading bacteria as the method of reducing TSNA content in the tobacco leaves during the curing and storage processes (WO 03/094639).

BRIEF SUMMARY OF THE INVENTION

The invention aims to suppress production of TSNA, which is produced during curing process of tobacco leaves, by using a microorganism and thus reduce the TSNA content in the tobacco leaves.

The inventors of the present invention have found that in the yellowing stage immediately after harvest, aerobic microorganisms such as microorganism belonging to *Pseudomonas, Agrobacterium*, or *Xanthomonas* genus are the dominant species (that is, species superior in numbers), however in the subsequent browning stage, facultatively anaerobic microorganisms having the nitrate-reducing ability (hereinafter also referred to as anaerobic microorganisms), particularly microorganism belonging to *Enterobacter* or *Pantoea* genus become the dominant species.

The facultatively anaerobic microorganisms have a high nitrate-reducing ability as compared with the aerobic microorganisms. Since TSNA are formed by reaction between nitrite-nitrogen and alkaloids contained in the tobacco leaves, if it is possible to inhibit accumulation of nitrite-nitrogen, the TSNA content in the tobacco leaves can be decreased.

The present invention relate to a method of reducing the TSNA content in tobacco leaves, comprising a step of inhibiting formation and accumulation of nitrite in the tobacco leaves by suppressing growth of the anaerobic microorganisms.

That is, the present invention relates to a method of reducing the TSNA content in tobacco leaves, comprising a step of inhibiting formation and accumulation of nitrite in the tobacco leaves by treating the tobacco leaves with a microorganism having no nitrate-reducing ability but having the ability of growth-competition with the anaerobic microorganism.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

As described above, in the curing process of tobacco leaves, the flora of microorganism in the surfaces of tobacco leaves is changed. In the yellowing stage immediately after harvest, aerobic microorganisms such as microorganisms belonging to *Pseudomonas, Agrobacterium*, or *Xanthomonas* genus are the dominant species (that is, species superior in numbers). On the other hand, in the subsequent browning stage, facultatively anaerobic microorganisms having the nitrate-reducing ability, particularly microorganisms belonging to *Enterobacter* or *Pantoea* genus become the dominant species.

Among these microorganism species, the facultatively anaerobic microorganisms have a high nitrate-reducing ability as compared with the aerobic microorganisms. Actually, in the case tobacco leaves are treated with microorganism belonging to *Enterobacter* or *Pantoea* genus that has been isolated from tobacco leaves in the browning stage, nitrite is accumulated compared to the non-treated leaves and the TSNA content is also increased in the treated tobacco leaves.

On the other hand, the present inventors well investigated microorganisms existing in the surfaces of the tobacco leaves of the browning stage together with the microorganism belonging to *Enterobacter* or *Pantoea* genus to find the existence of microorganisms having no ability of reducing nitrate to nitrite, and thus the microorganism is isolated in the present invention.

It is confirmed that in the case tobacco leaves are treated with the isolated microorganisms, the isolated microorganism is present competitively with the microorganism belonging to *Enterobacter* or *Pantoea* genus which is dominant species in the curing processing steps, and inhibits accumulation of nitrite in the tobacco leaves and accordingly suppresses the formation of TSNA.

Further, bacteriological characteristics of the isolated microorganism which suppresses the TSNA formation are investigated to identify the microorganism as *Flavimonas oryzihabitans*.

The present inventors name the bacteria strain as *Flavimonas oryzihabitans* K6001 (Deposit Accession No. NITE BP-677). The *Flavimonas oryzihabitans* K6001 (Deposit Accession No. NITE BP-677) strain has no nitrate-reducing ability and has the ability to compete in growth against the microorganisms belonging to *Enterobacter* or *Pantoea* genus which are anaerobic microorganisms. Accordingly, the microorganism to be used for the treatment of tobacco leaves in the present invention may be any microorganisms having no nitrate-reducing ability but having the ability of growth-competition with the anaerobic microorganisms. The anaerobic microorganisms as used herein are not particularly limited and include, for example, microorganisms belonging to *Enterobacter* or *Pantoea* genus. The microorganism having no nitrate-reducing ability but having the ability of growth-competition with anaerobic microorganisms may be any microorganisms belonging to *Flavimonas*, preferably *Flavimonas oryzihabitans*, and more preferably *Flavimonas oryzihabitans* K6001 (Deposit Accession No. NITE BP-677).

*Flavimonas oryzihabitans* K6001 (Deposit Accession No. NITE BP-677) is a bacterial strain newly isolated from surface of tobacco leaves by the present inventors, and the bacterial strain can be isolated from surface of tobacco leaves by any person skilled in the art. This bacterial strain has been stored and maintained in Leaf Tobacco Research Laboratory, Japan Tobacco Inc. and made available to anybody by the applicant. That is, the applicant is ready for providing the strain for anybody who requests it.

The method of the present invention can be carried out by employing the current method of curing tobacco leaves without alteration, except that treatment with the microorganism is carried out.

Tobacco leaves to be treated according to the present invention may be any tobacco variety as long as the tobacco leaves allow the conventional curing process. Preferable examples are specifically Burley tobacco and Japanese domestic tobacco as an air-cured tobacco.

The time when tobacco leaves are treated with the microorganism according to the method of the present invention may be any stage in which nitrate in the tobacco leaves is reduced. The treatment is preferably carried out before the anaerobic microorganism having nitrate-reducing ability becomes a dominant species in the tobacco leaves, that is, before the browning stage of the curing processing steps. For example, tobacco leaves may be treated in a field immediately before harvest and thereafter harvested and cured, or may be treated immediately after harvest and then cured.

The treatment with the microorganism may be carried out once or two or three times periodically.

The "treatment" with the microorganism in the present invention means addition of microorganism to object tobacco leaves and may be carried out by any of known methods; examples thereof include spraying of suspension of the microorganism and coating of a powder containing the bacterial cells of the microorganism.

As a culture medium for culturing the microorganism used in the present invention, various types of known culture media for culturing microorganism can be used. Also, with respect to the culturing conditions under which the microorganism is cultured, the temperature may be in a range of 25 to 35° C., preferably in a range of 28 to 32° C., and pH may be in a range of 6.0 to 8.0, preferably approximately 7.0.

In the preparation of the microorganism used in the present invention, the microorganism is cultured for a predetermined period and then collected by centrifugation and suspended in a specific buffer solution to prepare a bacterial suspension. The buffer solution for suspending the bacterial cells may be, for example, sterilized distilled water and phosphate buffer.

In the case the bacterial cells are suspended in the buffer solution, the concentration of the bacterial cells suspended in the buffer solution may be $10^7$ to $10^{12}$, preferably $10^8$ to $10^{10}$ cells per 1 mL of the buffer solution. The bacterial suspension having the above concentration is preferably used in the present invention.

In the present invention, the treatment of tobacco leaves is carried out by using the bacterial suspension prepared as described above. For example, the bacterial suspension that is an inoculation solution for inoculating into tobacco leaves is prepared by adding sterilized distilled water to the bacterial sample containing a necessary amount of the bacterial cells and the obtained solution may be evenly sprayed on the tobacco leaves.

With respect to the amount of the inoculation solution to be sprayed, when the treatment is carried out immediately after harvest or at the initial stage of the curing process, 2 to 10 mL of the inoculation solution may be applied per one piece of tobacco leaf. When the treatment is carried out at an intermediate stage of the curing process or thereafter, 0.5 to 3 mL of the inoculation solution may be applied per one piece of tobacco leaf. With respect to the number of times of the treatment, it suffices that the treatment is carried out at least once, preferably two or three times with an interval between each treatment, during the curing and/or storage processes.

According to the present invention, tobacco leaves as a raw material with reduced TSNA content are provided. In the method of the present invention, no significant change is brought into the curing process, except that the tobacco leaves are treated with the microorganism, and therefore it is possible to reduce the TSNA content without causing any adverse effect on the natural flavor and taste of the tobacco leaves.

EXAMPLES

Example 1

Isolation of the Microorganisms from the Surface of Tobacco Leaves

The microorganism was isolated from tobacco leaves grown in a tobacco field in Oyama-shi, Tochigi prefecture, Japan.

The leaves of Michinoku 1, which is Burley variety, were harvested, and the lamina portions of the harvested tobacco leaves were cut off as samples. The obtained samples were finely cut to 5 mm squares and approximately 10 g of the cut samples was put into a 300 mL Erlenmeyer flask. After that, 200 mL of 10 mM phosphate buffer (pH 7.0) was added thereto and the mixture was homogenized. The obtained suspension was used as a tobacco suspension for isolation of microorganisms.

The obtained tobacco suspension was diluted with the above phosphate buffer to a concentration proper for isolation of microorganisms ($10^2$ to $10^5$ times dilution).

The diluted suspension was applied, by dropping 0.1 mL a time, on a YG agar plate medium (yeast extract 1.0 g; glucose 1.0 g; $K_2HPO_4$ 0.3 g; $KH_2PO_4$ 0.2 g; $MgSO_4.7H_2O$ 0.2 g; agar 15 g; and distilled water 1,000 mL, pH 6.8), and then cultured at 30° C. for 7 days.

The grown colonies were separated into a single colony by using a fresh YG agar plate medium. The isolated microorganisms were stored at −80° C. till used for experiments.

To culture the sample microorganism, the YG agar plate medium was used. The grown microorganism was suspended in sterilized distilled water in a concentration of about $10^7$ cfu/mL to obtain a microbial suspension.

Each microbial suspension 100 μL was inoculated in each test tube containing 1 mL of Giltay liquid medium ($KNO_3$ 1.0 g; asparagine 1.0 g; 1% bromothymol blue solution 5 mL; sodium citrate 8.5 g; $MgSO_4.7H_2O$ 1.0 g; $FeCl_3.6H_2O$ 0.05 g; $KH_2PO_4$ 1.0 g; $CaCl_2.6H_2O$ 0.2 g; and distilled water 1,000 mL; pH 7.0), and cultured at 30° C. for 7 days.

With respect to the Giltay liquid medium, occurrence of nitrite formation in the medium was investigated by adding a Griess-Ilosvay reagent (prepared by mixing equimolar amounts of a 1st solution containing sulfanilic acid 0.5 g; acetic acid 30 mL; and distilled water 70 mL and a 2nd solution containing α-naphthylamine 0.5 g; acetic acid 30 mL and distilled water 70 mL).

As a result, 3 strains of microorganism which formed no nitrite in the above-mentioned medium, that is, had no nitrate-reducing ability were isolated.

Example 2

The Effect on Reduction of TSNA Content

The tobacco leaves were treated with the isolated three strains having no nitrate-reducing ability, and the TSNA contents in the tobacco leaves were investigated.

The selected three microbial strains were inoculated in Tryptic Soy broth (manufactured by Difco Co., Ltd., Bacto Tryptic Soy Broth; that is, Soybean-Casein Digest Medium; hereinafter referred to as 1/10 TS broth) and cultured at 30° C. for 72 hours.

[Composition of the 1/10 TS Broth]

| Final volume | adjusted to 1,000 mL by adding distilled water |
|---|---|
| Casein | 1.7 g |
| D-glucose | 0.25 g |
| NaCl | 0.5 g |
| $K_2HPO_4$ | 2.5 g |

After the culture, the culture medium containing the bacterial cells was subjected to centrifugation at 5,000 rpm to collect the bacterial cells. The obtained bacterial cells were washed twice with sterilized distilled water and then suspended again in sterilized distilled water. The concentration of the microorganism in the suspension was adjusted to be $10^8$ to $10^{10}$ cfu/mL with distilled water.

Tobacco leaves of Burley variety (Kitakami 1) which had been harvested to be brought into the curing process were treated with the above-mentioned microbial suspension.

Also, the tobacco leaves of Burley variety (Kitakami 1) which had been harvested to be brought into the curing process were treated with a suspension containing $10^8$ to $10^{10}$ cfu/mL of bacterial cells of *Enterobacter cloacae* isolated in the same manner as Example 1.

The treatment was carried out three times, i.e., immediately after the harvest, 3 days after the harvest, and 8 days after the harvest (before the browning stage). In each treatment, the suspension was sprayed on the front and back surfaces of the tobacco leaves such that 10 mL thereof was sprayed per one piece of tobacco leaf.

The tobacco leaves were air-cured by using a pipe house. In the control group, tobacco leaves were air-cured without the treatment or in the conventional manner.

The non-treated and treated tobacco leaves each were collected on 10th day and 21st day in the curing process. The collected tobacco leaves were separated into the lamina and stem parts and freeze-dried.

Each sample of the freeze-dried lamina was ground by a mixer and subjected to TSNA content determination.

About 5 g of each ground lamina sample was put into a 200 mL Erlenmeyer flask, mixed with 100 mL of 0.01 M NaOH solution (containing Thimerosal 100 μg/mL), and subjected to extraction at a room temperature for 2 hours by using an agitator. Thereafter, the extract was filtrated with a filter paper (ADVANTEC Co., Ltd., No. 5C).

Contents of NNN, NNK, NAT, and NAB were determined by gas chromatography in accordance with an improved method of Spiegelhalder (Spiegelhalder B., Kubacki S. and Fischer S. (1989) Beitr. Tabakforsch. Int., 14(3), 135-143, Fischer S. and Spiegelhalder B., (1989) Beitr. Tabakforsch. Int., 14(3), 145-153).

At first, 10 mL of each filtrate was applied on a column filled with Kieselgur (particle diameter: 60 to 160 mm; manufactured by MERCK Co., Ltd.) and ascorbic acid. TSNA was eluted with dichloromethane. The eluted dichloromethane solution was used as a sample for gas chromatography. Each obtained sample was analyzed using Gas Chromatography HP 6890 (manufactured by Hewlett-Packard Co., Ltd.) equipped with Column DB-17 (manufactured by J & W Co., Ltd.) and Detector TEA-543 (manufactured by Thermedics Co., Ltd.).

The results are shown in Table 1. In Table 1, one strain was named as K6001 strain which showed most significant reduction of the TSNA content and shown separately from other two strains (non-nitrate-reducing bacteria A and B).

TABLE 1

Change in TSNA content in tobacco leaves during curing process (μg/g)

| Days after harvest | Treatment | NNN | NNK | NAT | NAB | Total TSNA |
|---|---|---|---|---|---|---|
| 0 day | Group common to all | 0.22 | 0.04 | 0.26 | 0.2 | 0.53 |
| 10 days | Not-treated | 0.45 | 0.15 | 0.39 | ND | 0.99 |
| | Treated with K6001 | 0.42 | 0.15 | 0.31 | ND | 0.88 |
| | Treated with non-nitrate-reducing bacterium A | 0.71 | 0.84 | 0.00 | 0.59 | 2.14 |
| | Treated with non-nitrate-reducing bacterium B | 0.91 | 0.59 | 0.00 | 0.40 | 1.90 |
| | Treated with *Enterobacter cloacae* | 2.24 | 1.78 | 0.07 | 1.16 | 5.25 |
| 21 days | Not-treated | 1.51 | 0.52 | 0.98 | ND | 3.01 |
| | Treated with K6001 | 0.99 | 0.40 | 0.76 | ND | 2.15 |
| | Treated with non-nitrate-reducing bacterium A | 2.12 | 1.41 | 0.03 | 0.78 | 4.35 |
| | Treated with non-nitrate-reducing bacterium B | 2.02 | 1.63 | 0.05 | 1.17 | 4.86 |
| | Treated with *Enterobacter cloacae* | 3.97 | 2.27 | 0.00 | 1.06 | 7.30 |

The TSNA content was found highest in the group subjected to the treatment with *Enterobacter cloacae*. On the other hand, the TSNA content was found not even in the groups subjected to the treatment with the three stains of non-nitrate-reducing bacteria, and the TSNA content was higher in the groups subjected to the treatment with non-nitrate-reducing bacteria A and B than in the not-treated group.

According to the above-mentioned results, it is shown that the K6001 strain is able to survive competitively even in the curing process of tobacco leaves in which the microorganism of *Enterobacter* genus is dominant species and that the K6001 strain is able to suppress TSNA production in the tobacco leaves.

Example 3

Measurement of Nitrite-Nitrogen Content

Measurement of the content of nitrite-nitrogen in tobacco leaves treated with non-nitrate-reducing bacteria was carried out in the K6001 strain and the non-nitrate-reducing bacterium A.

The measurement method of the nitrite-nitrogen content will be described below.

At first, about 0.5 g of lamina was collected from tobacco leaves of each group and placed in a 50 mL centrifuge tube, and 25 mL of an extraction solution described below was added thereto. The mixture was then agitated at a room temperature for 30 minutes to extract nitrite-nitrogen. Each obtained extract was filtrated by using a filter paper (ADVANTEC, No. 1) and 10 mL of the extract was put into another centrifuge tube, mixed with activated carbon 0.5 g, and agitated at a room temperature for 15 minutes. Further, the activated carbon was removed by filtration with a filter paper (ADVANTEC, No. 5). The obtained filtrate was used as a sample for determining the nitrite-nitrogen content.

Extraction Solution:

| | |
|---|---|
| KCl | (1% KCl) |
| Sulfanylamide | (0.5% sulfanylamide) |
| Triton X-100 | (0.1% Triton X-100) |

In the determination of the nitrite-nitrogen content in the extract, an autoanalyzer (manufactured by BRAN +LUEBBE Co., Ltd., AACSII) was used and the nitrite-nitrogen content was calculated by converting the transmittance of the filter at 550 nm to the nitrite-nitrogen content. For coloring nitrite-nitrogen, 1% of sulfanylamide and 0.1% of N-naphthylethylenediamine dihydrochloride were used.

The results are shown in Table 2.

TABLE 2

Change in nitrite-nitrogen content in tobacco leaves during curing process (μg/g)

| Treatment | Days after harvest 0 | 10 | 21 |
|---|---|---|---|
| Not-treated | 0.71 | 1.25 | 4.32 |
| Treated with water | | 3.29 | 4.54 |
| Treated with K6001 | | 1.39 | 2.90 |
| Treated with non-nitrate-reducing bacterium A | | 3.10 | 6.24 |

There was difference among stains of the non-nitrate-reducing bacteria, and the nitrite-nitrogen content in the leaves treated with K6001 was found higher than that in the not-treated leaves on 10th day in the curing process, but lower on 21st day in the curing process. On the other hand, the nitrite-nitrogen content in the leaves treated with the non-nitrate-reducing bacterium A which showed no reduction of the TSNA content was higher than that in the not-treated leaves.

According to above-mentioned results, it is shown that the K6001 strain is able to suppress nitrite-nitrogen formation in the tobacco leaves and thus suppress TSNA formation. In other words, it is shown that the K6001 strain is competitive with the nitrate-reducing bacteria.

The bacteriological characteristics of the K6001 strain are shown in Table 3.

TABLE 3

Principal characteristics of K6001 strain and identification result

| Tested items | K6001 |
|---|---|
| Shape | Rod |
| Gram stain | − |
| Spore | − |
| Motility | + |
| Behavior toward oxygen | Aerobic |
| Oxidase | − |
| Catalase | + |
| OF | ○ |
| Color tone of colony | Yellowish |
| Reduction of nitrate | − |
| Production of indole | − |
| Fermentation of glucose | − |
| Arginine dihydrolase | − |
| Urease | − |
| Degradationof of esculin | − |
| Liquefiability of gelatin | − |
| β-galactosidase | − |
| Utilization | |
| Glucose | + |
| L-arabinose | + |
| D-mannose | + |
| D-mannitol | + |
| N-acetyl-D-glucosamine | − |
| Maltose | + |
| Potassium gluconate | + |
| n-capric acid | + |
| Adipic acid | − |

TABLE 3-continued

Principal characteristics of K6001 strain and identification result

| Tested items | K6001 |
|---|---|
| dl-malic acid | + |
| Sodium citrate | + |
| Phenyl acetate | − |
| Identification result | Flavimonas oryzihabitans |

* Identification result by Japan Food Research Laboratories

According to the above-mentioned results, the K6001 strain was identified as microorganism belonging to *Flavimonas oryzihabitans*. The bacterium was identified relying on Japan Food Research Laboratories.

In accordance with the invention, there is provided a method of reducing TSNA content that is applicable to the current curing and/or storage processes.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of reducing the content of Tobacco Specific Nitrosamines (TSNA) in tobacco leaves, comprising treating the tobacco leaves with an isolated *Flavimonas oryzihabitans* K6001 (Deposit Accession No. NITE BP-677) having no nitrate-reducing ability but having the ability of growth-competition with an anaerobic microorganism, by the following (i) or (ii):

(i) spraying a suspension containing the microorganism on a surface of the tobacco leaves, or (ii) coating a surface of the tobacco leaves with a powder containing the microorganism.

2. A method of reducing the content of Tobacco Specific Nitrosamines (TSNA) in tobacco leaves, comprising treating the tobacco leaves with an isolated *Flavimonas oryzihabitans* K6001 (Deposit Accession No. NITE BP-677) having no nitrate-reducing ability but having the ability of growth-competition with an anaerobic microorganism, by the following (i) or (ii), before the anaerobic microorganism becomes dominant species in the tobacco leaves:

(i) spraying a suspension containing the microorganism on a surface of the tobacco leaves, or (ii) coating a surface of the tobacco leaves with a powder containing the microorganism.

3. The method according to claim 1, wherein the anaerobic microorganism is a microorganism belonging to *Enterobacter* or *Pantoea* genus.

4. The method according to claim 2, wherein the anaerobic microorganism is a microorganism belonging to *Enterobacter* or *Pantoca* genus.

5. The method according to claim 1, wherein said treating is performed after the tobacco leaves are harvested.

6. The method according to claim 2, wherein said treating is performed after the tobacco leaves are harvested.

* * * * *